US008468967B2

(12) United States Patent
Peschka et al.

(10) Patent No.: US 8,468,967 B2
(45) Date of Patent: Jun. 25, 2013

(54) WIDE-SLOT NOZZLE

(75) Inventors: Manfred Peschka, Aachen (DE); Bernd Hauschild, Apensen (DE)

(73) Assignee: Fraunhofer-Gesellschaft zur Foerderung der angewandten Forschung e.V. (DE)

( * ) Notice: Subject to any disclaimer, the term of this patent is extended or adjusted under 35 U.S.C. 154(b) by 268 days.

(21) Appl. No.: 12/956,790

(22) Filed: Nov. 30, 2010

(65) Prior Publication Data

US 2011/0132940 A1 Jun. 9, 2011

Related U.S. Application Data

(63) Continuation of application No. PCT/EP2009/056589, filed on May 29, 2009.

(30) Foreign Application Priority Data

May 30, 2008 (DE) ..... 10 2008 026 147

(51) Int. Cl.
*B05C 5/00* (2006.01)
*A62C 31/00* (2006.01)

(52) U.S. Cl.
USPC ..... 118/301; 239/436

(58) Field of Classification Search
None
See application file for complete search history.

(56) References Cited

U.S. PATENT DOCUMENTS

| | | | | |
|---|---|---|---|---|
| 3,220,653 | A * | 11/1965 | Waldrum | 239/97 |
| 3,949,666 | A * | 4/1976 | Zimmer | 101/119 |
| 2003/0230647 | A1 * | 12/2003 | Puffe | 239/550 |
| 2006/0016391 | A1 | 1/2006 | Puffe | |

FOREIGN PATENT DOCUMENTS

| | | | |
|---|---|---|---|
| DE | 3322154 | A1 | 2/1984 |
| DE | 19757237 | A1 | 7/1999 |
| DE | 10216356 | C1 | 9/2003 |
| DE | 10306884 | B3 | 6/2004 |
| GB | 1169973 | A | 11/1969 |

OTHER PUBLICATIONS

International Search Report and Written Opinion of the International Searching Authority; PCT/EP2009/056589; Sep. 11, 2009; 9 pages.

* cited by examiner

*Primary Examiner* — Dah-Wei Yuan
*Assistant Examiner* — Charles Capozzi
(74) *Attorney, Agent, or Firm* — St. Onge Steward Johnston & Reens LLC

(57) ABSTRACT

A device for applying a flowable medium onto a level workpiece surface, including a housing forming an elongated outlet nozzle for the medium and an essentially cylindrical media distributor which is rotatably arranged in the housing and includes a slot that changes its position relative to the outlet nozzle by rotating the media distributor and whose outer surface forms sealing surfaces which rest sealingly against sealing surfaces of the housing. In order to develop the device such that low- to medium-viscosity media can be applied with a closed surface onto a level workpiece surface, the media distributor is a pipe whose interior is formed by a reservoir that can be fed with the medium via a feed opening and that the slot extends in such a manner that, by rotation of the media distributor, it can be brought from an open position, in which it forms an open, continuous opening essentially over its entire length from the reservoir to the outlet nozzle, to a closed position in which the continuous opening is completely closed.

13 Claims, 9 Drawing Sheets

WIDE-SLOT NOZZLE

CROSS-REFERENCE TO RELATED APPLICATIONS

The present application is a continuation of pending International patent application PCT/EP2009/056589 filed on May 29, 2009 which designates the United States and claims priority from German patent application 10 2008 026 147.5-51 filed on May 30, 2008, the content of which is incorporated herein by reference.

FIELD OF THE INVENTION

The invention relates to a device for applying a flowable medium onto a planar surface of a workpiece, the device having a housing that forms an elongate discharge nozzle for the medium and a media distributor which is rotatably disposed in the housing and is formed as a cylindrical tube, the media distributor having a slot running in the axial direction of the tube, the position of the slot with respect to the discharge nozzle being altered by rotation of the medium distributor, and the outer surface of the medium distributor forming sealing surfaces which engage in a sealing manner against counter-sealing surfaces, the interior of the tube forming a reservoir which can be supplied with the medium by a supply opening, the slot running in such a manner that it can be brought by rotation of the medium distributor from an open position, in which it forms a through opening from the reservoir to the discharge nozzle, the opening being open substantially over its entire length, into a closed position in which the through opening is completely closed.

BACKGROUND OF THE INVENTION

A device of the kind in question is known from DE 33 22 154. In this case, a tubular media distributor that has a slot extending in the axial direction of the tube is mounted in a two-part housing. The tube, which has a circular cross-section, is rotatably mounted in an inner cylinder which is congruent with the tube. The two housing portions respectively form two halves of the inner cylinder, a lower housing portion having a discharge slot which is flanked by two discharge lips. The lower housing portion has, in the region of the inner cylinder, a recess that extends along the edge of the discharge slot and has a tapering wedge-shaped base. By rotating the media distributor, the slot-form outlet is brought into the region of this recess. The spacing of the base of this recess depends on the rotary position of the tube. The recess forms a throttle, so that the quantity flowing through the gap may be adjusted by varying the rotary position of the tube.

DE 197 57 237 C2 describes a device in which there is a longitudinal slot in a substantially rectangular housing, the slot forming a discharge nozzle extending substantially over the entire length of the housing. A roller within the housing has a helical slot on the surface of the roller. There is a reservoir for accommodating a flowable medium between the outer wall of the roller and the inner wall of the housing and the medium may be a fluidized thermoplastic material or a molten heat-meltable adhesive. The surface of the roller is in sealing engagement against the base surface of the housing, in which there is the discharge nozzle formed by a longitudinal slot. The helical slot of the medium distributor thus crosses the discharge nozzle at a number of locations spaced apart from one another. The flowable medium may exit from the discharge nozzle at these crossing points. If the medium distributor is rotated, this exit point travels along in the direction of extent of the nozzle. By means of the rotary application head described here, threads of adhesive separated from one another may be applied to a planar workpiece surface.

SUMMARY OF THE INVENTION

It is an object of the invention to further develop a device of the generic kind such that media of low to medium viscosity may be applied to a planar workpiece over its entire surface, with it being possible to turn the mass flow of the medium on and off with precision.

This object is met by the invention specified in the claims, the subsidiary claims providing initially advantageous developments of the claims 1 and 6 to which they are subordinated.

First and foremost it is provided that the counter-sealing surfaces are not formed by the housing but by a sealing strip which is inserted in a cut-out in the housing and has a slot aligned with the discharge nozzle. As a result of this configuration, a high sealing action can be achieved, in particular by targeted application of a local pressure, so that the mass flow may be turned on and off with precision. The interior of the tube forms a reservoir which can be supplied with a medium from a supply opening. The tube has a slot. This runs in such a manner that it can be brought from an open position into a closed position by rotation of the tube. In the open position, there is formed a through opening from the reservoir to the discharge nozzle, the opening being open substantially over the entire length of the discharge opening. In the closed position, this through opening is completely closed. The housing is preferably formed by a half tube. The discharge nozzle runs centrally in this half tube. The half tube forms a shell which accommodates the medium distributor. The half tube provides moreover the sealing strip disposed in the region of the discharge nozzle. The thickness of the material of the sealing strip is preferably greater than the depth of the cut-out, so that the sealing strip projects out of the cut-out in the manner of a pedestal. The inner wall of the housing is thus at a spacing from the outer wall of the media distributor. The width of the sealing strip is limited to the immediate apex region of the tube. The sealing surfaces formed by the sealing strip run on the cylindrical inner surface. The sealing strip forms sealing surfaces adapted to the outer surface of the tube forming the medium distributor. The medium distributor is pressed against these sealing surfaces by pressing pieces so that no medium may exit from the reservoir in the closed position. If the medium distributor is rotated into the open position, the medium may flow through the slot of the tube and the slit of the sealing strip into the slot forming the discharge nozzle, in order to exit in a uniform manner from the discharge nozzle. In order to increase the stability, the slit of the sealing strip may be interrupted by a number of webs. The webs are spaced apart from one another, the spacing between the webs equating to at least ten times the width of the slit. The length of the web measured in the direction of extent of the discharge nozzle equates approximately to the width of the slit. The medium distributor has a peripheral cross-sectional contour which is substantially circular. Pressing rollers of the pressing pieces press against the outside surface running on this circumferential contour. The pressing pieces are spaced apart from one another and have an arcuate shape. The ends of the arcuate pieces are bolted to the edges of the half tube by means of clamping bolts. In cross-section, the pressure rollers engage against the discharge nozzle, an isosceles triangle with acute angles being formed. The force with which the pressing pieces urge the sealing surfaces of the tube against the sealing surfaces of the sealing strip may be locally adjusted by means of the clamping bolts. The tube forming the medium distributor is closed at its ends by mounting plugs. One of the two mounting plugs forms an extension which is connected to a switch lever by means of which the medium distributor may be rotated. The mounting plug opposite from this mounting plug forms the supply opening. The supply opening thus lies at the centre of rotation of the medium distributor. The two ends of the half tube are connected to headpieces in which mounting plugs are mounted by plain bearings. The half tube may consist of two quarter tubes, which are connected to one another by means of the two headpieces or alternatively by means of the sealing strip and are in particular glued. The tube forming the medium distributor may be axially-slotted over its entire length. The ends of the tube may be glued to the mounting plugs. The wide-slot nozzle according to the invention enables application of low to average viscosity media and consists substantially of a slotted tube which at the same time forms a material reservoir. This tube has one or two lateral connections for supply of media. The discharge nozzle forms the counter contour to the slot of the roller. The sealing strip has two sealing surfaces spaced apart from one another by a slit, outer wall portions of the tube adjacent the slit engaging against the sealing surfaces in a sealing manner. The sealing strip thus lies between the slotted roller and the discharge nozzle. By means of the pressure pieces, the slotted roller forming the media distributor can be pressed in a locally targeted manner against the flanks of the discharge nozzle. The material reservoir is dimensioned such that a uniform pressure prevails in the slotted hollow roller, preferably of an order of magnitude of 0.5 to 6 bar. In this way, it is achieved that even when the width of application is great, in particular from 500 mm to 1,000 mm, there results a uniform application of media. By rotation of the slotted roller, in particular by way of the switch lever, connection of the reservoir to the discharge nozzle is enabled. Both a defined start of application as well as a defined end to the application are possible. By means of the wide-slot nozzle according to the invention, texture paints may be applied to surfaces of work pieces. By means of the invention, vertically aligned surfaces may also be coated. It is even possible for the nozzle to be used with a head. In this way, the radially projecting lips that flank the discharge nozzle prove to be advantageous.

BRIEF DESCRIPTION OF THE DRAWINGS

An exemplary embodiment of the invention will be described below with reference to accompanying drawings, in which:

FIG. 7 shows a section on the line VII-VII in FIG. 2.

DETAILED DESCRIPTION OF THE INVENTION

Figure 1:
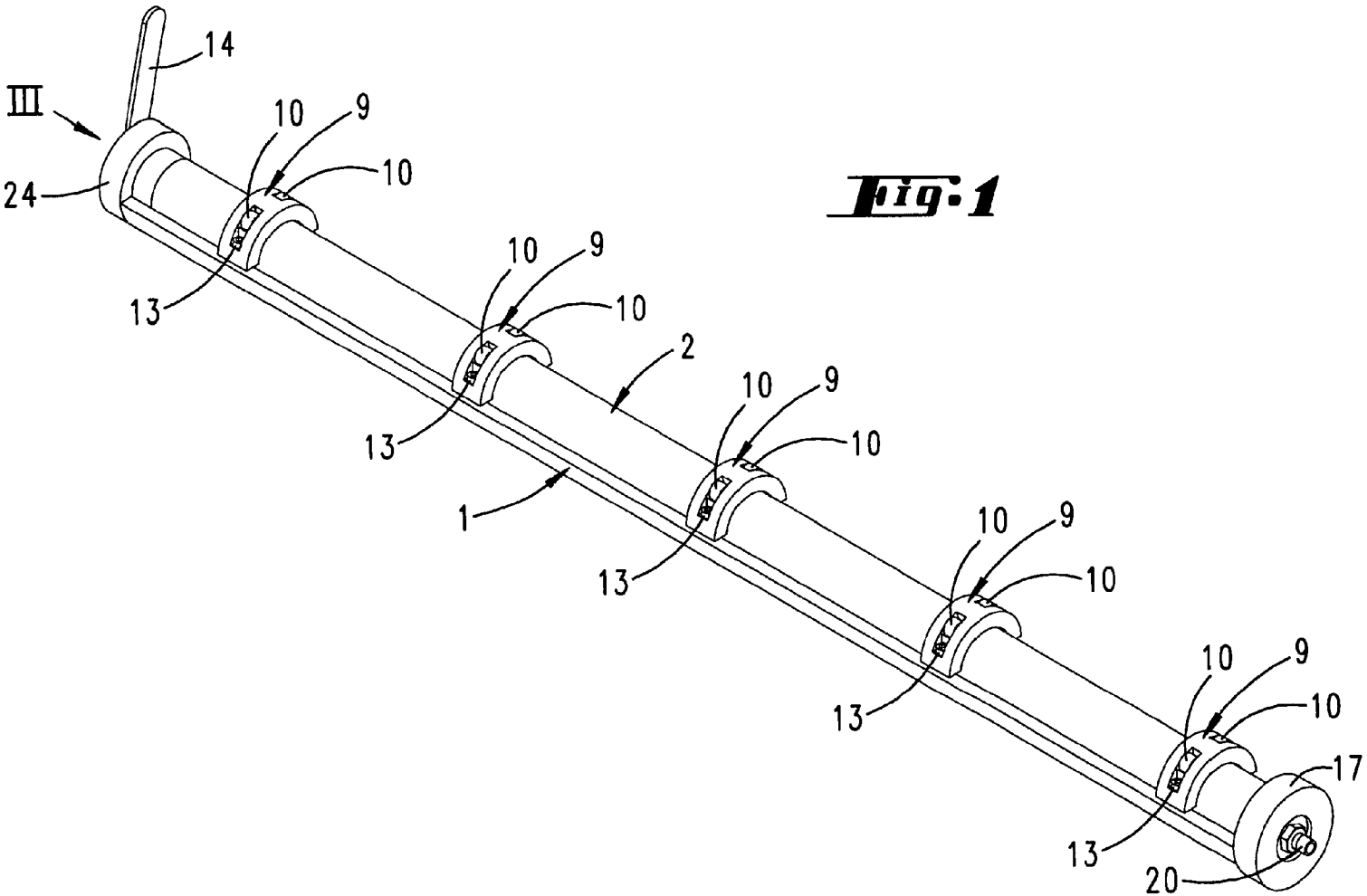
FIG. 1 shows a wide-slot nozzle in a first perspective representation.
Figure 2:
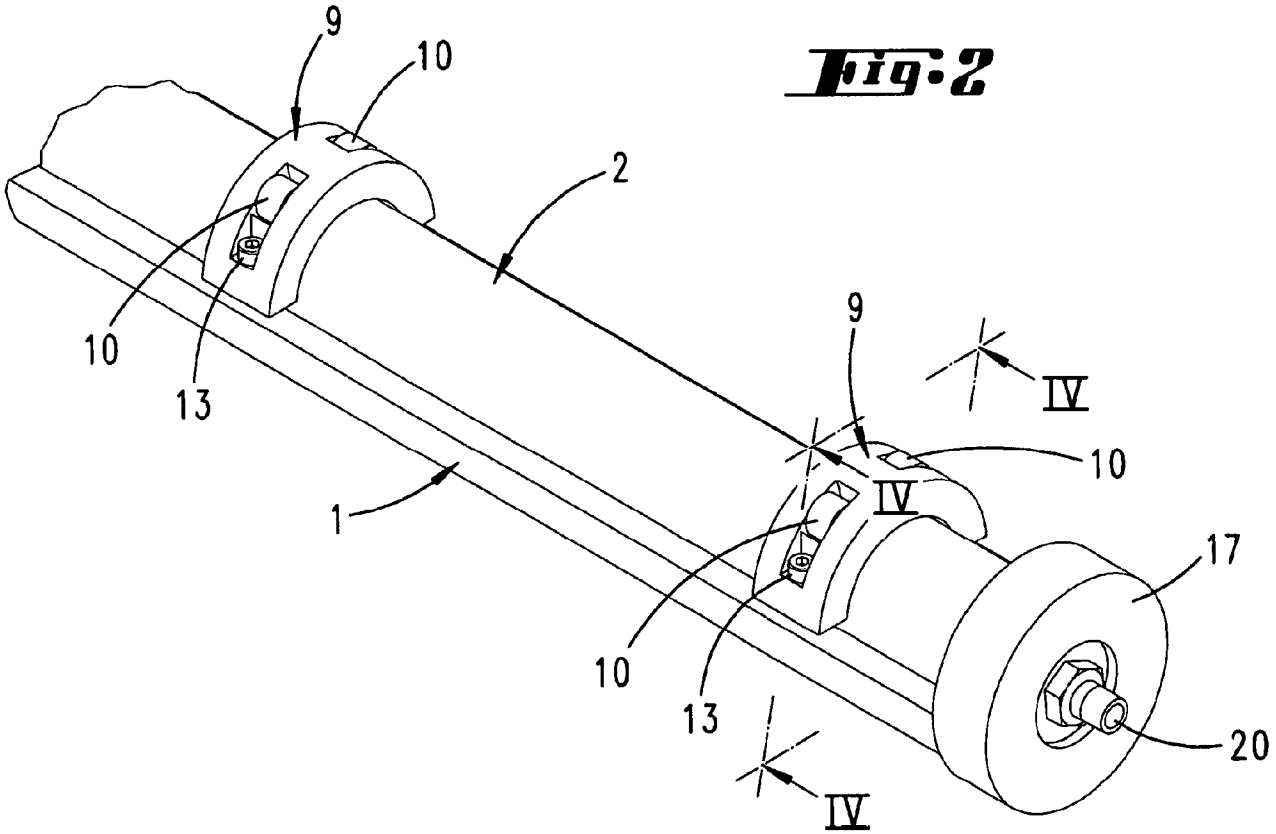
FIG. 2 shows an enlarged representation of the end shown to the right in FIG. 1.
Figure 3:
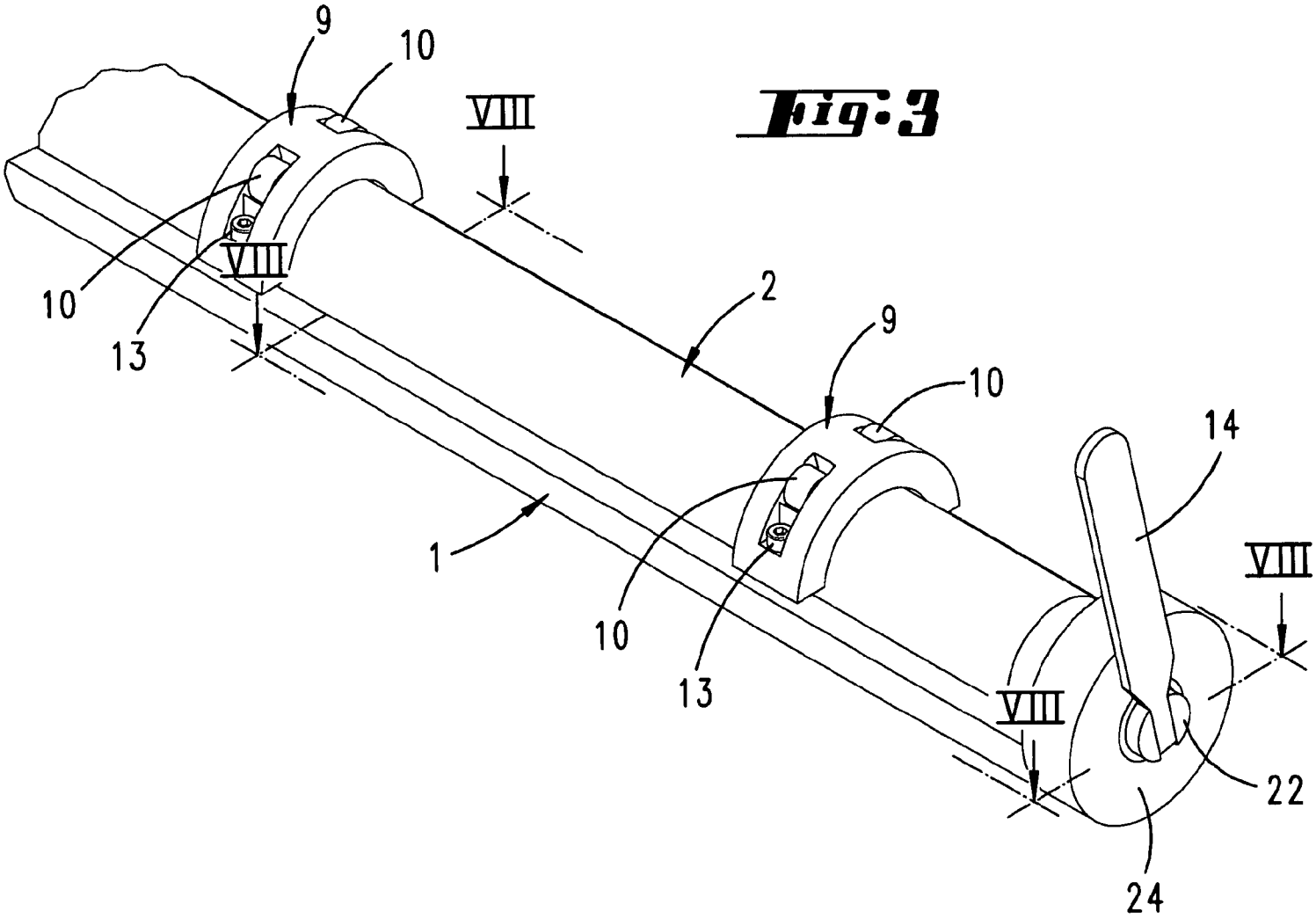
FIG. 3 shows an enlarged representation of the end shown to the left in FIG. 1, in the viewing direction of the arrow III in FIG. 1.
Figure 4:
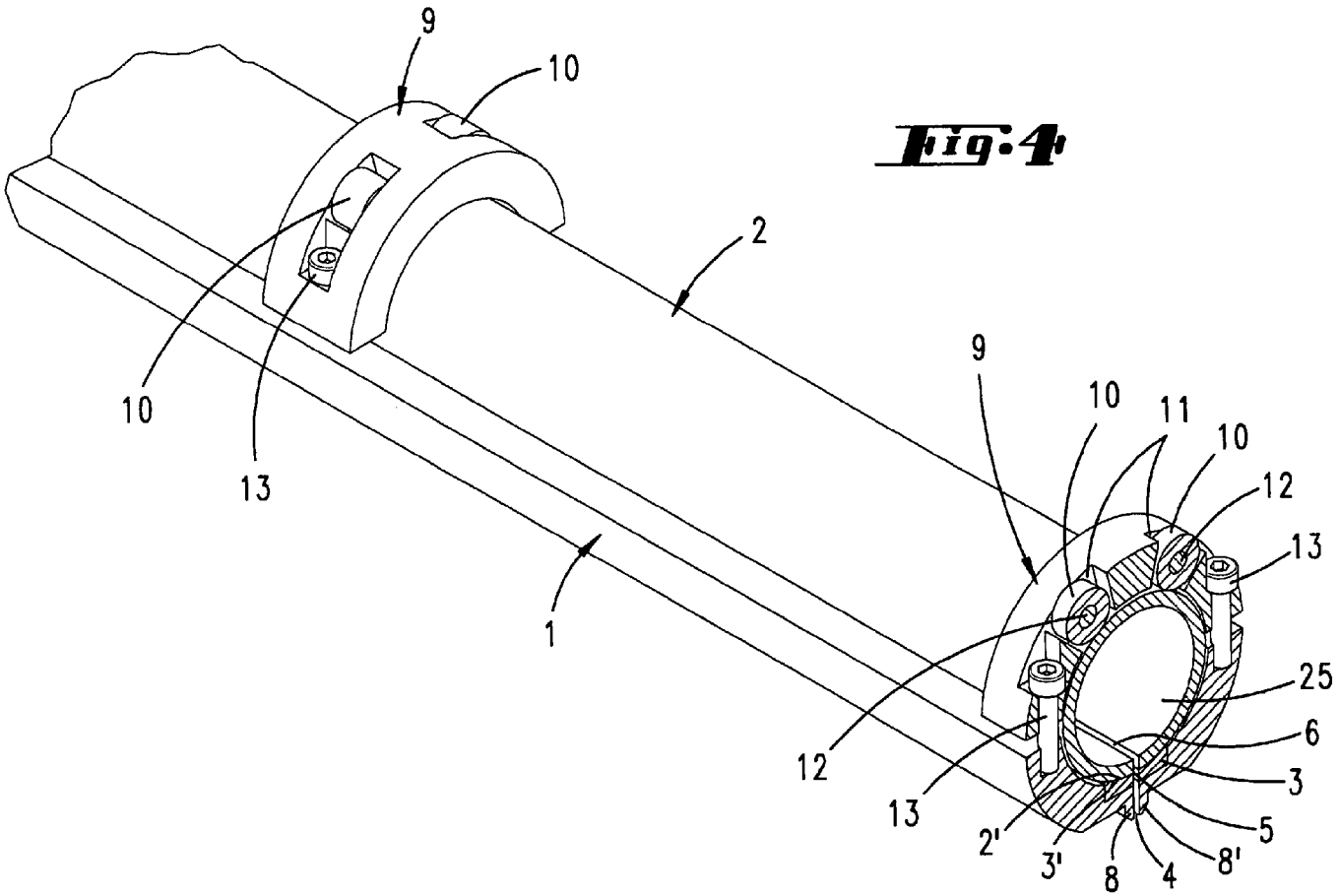
FIG. 4 shows a section on the line IV-IV in FIG. 2.

While the discharge nozzle 4 extends over the entire axial length of the half tube 1, the slit 5 of the sealing strip 3 has interruptions in the form of webs 15 that are spaced apart from one another. The slit 5 also does not extend right up to the respective ends of the sealing strip 3 so that these portions effect a stabilizing action. The sealing strip 3 may be glued into the cut-out 7. The strip forms a sealing surface 3' flanking the slit 5, the sealing surface being curved inwardly in the manner of an arc of a circle, whereby the run of the arc of the sealing surface 3' is matched to the outer contour of a tube 2.

With respect to the axis of the tube 2, the sealing surface 2' of the tube 2 and the sealing surface 3' of the sealing strip extend only over ⅛ of a circle. The angle $\alpha$, over which the sealing surface extends, may preferably be in a range from 30 to 60°. Support of the tube 2 in the region of the slit 5 thus extends only over a delimited circumferential region, which is formed by the curved surface 3' of the sealing strip 3 that projects in the manner of a pedestal above the inner wall 26 of the housing 1. As a result of this, an arcuate clearance 28 is formed between the outer wall 27 of the tube 2 and the inner wall 26 of the housing 1 that is an inner cylindrical surface.

Figure 6:
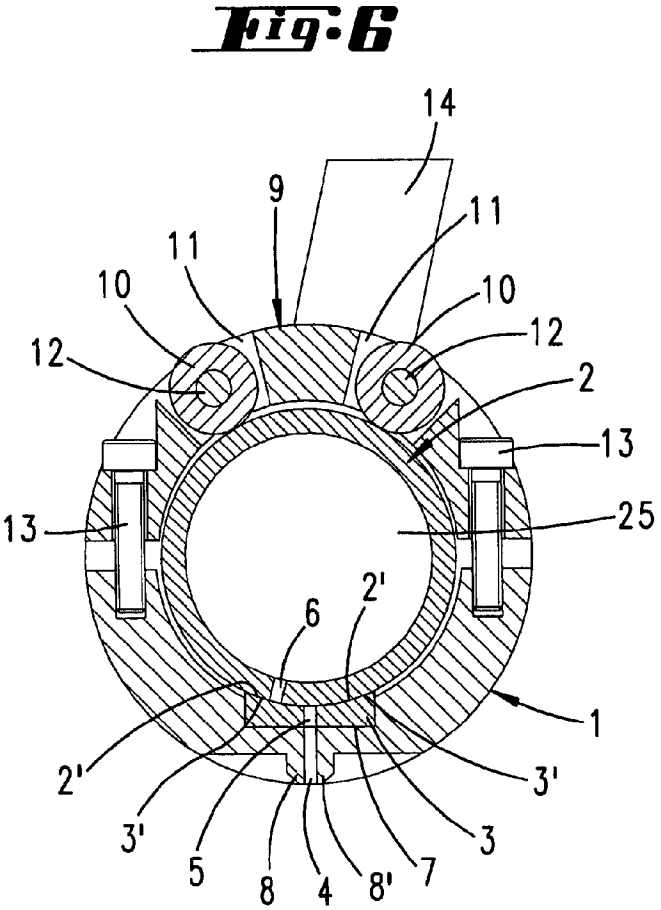
FIG. 6 is a representation according to FIG. 5 in the closed position.
Figure 5:
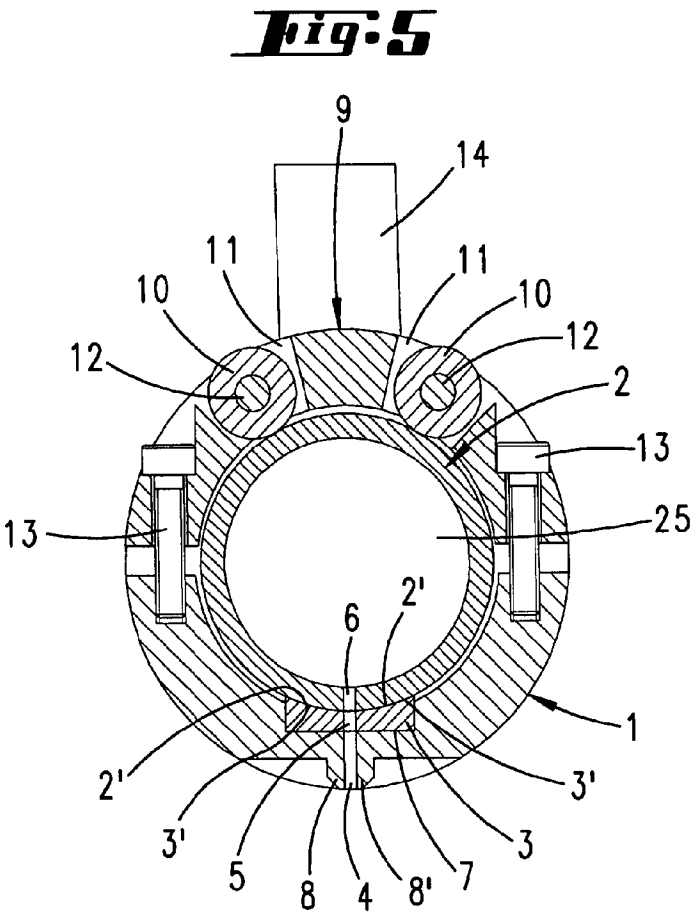
FIG. 5 shows the section according to FIG. 4 in a view onto the section plane in the opening position.
Figure 1:
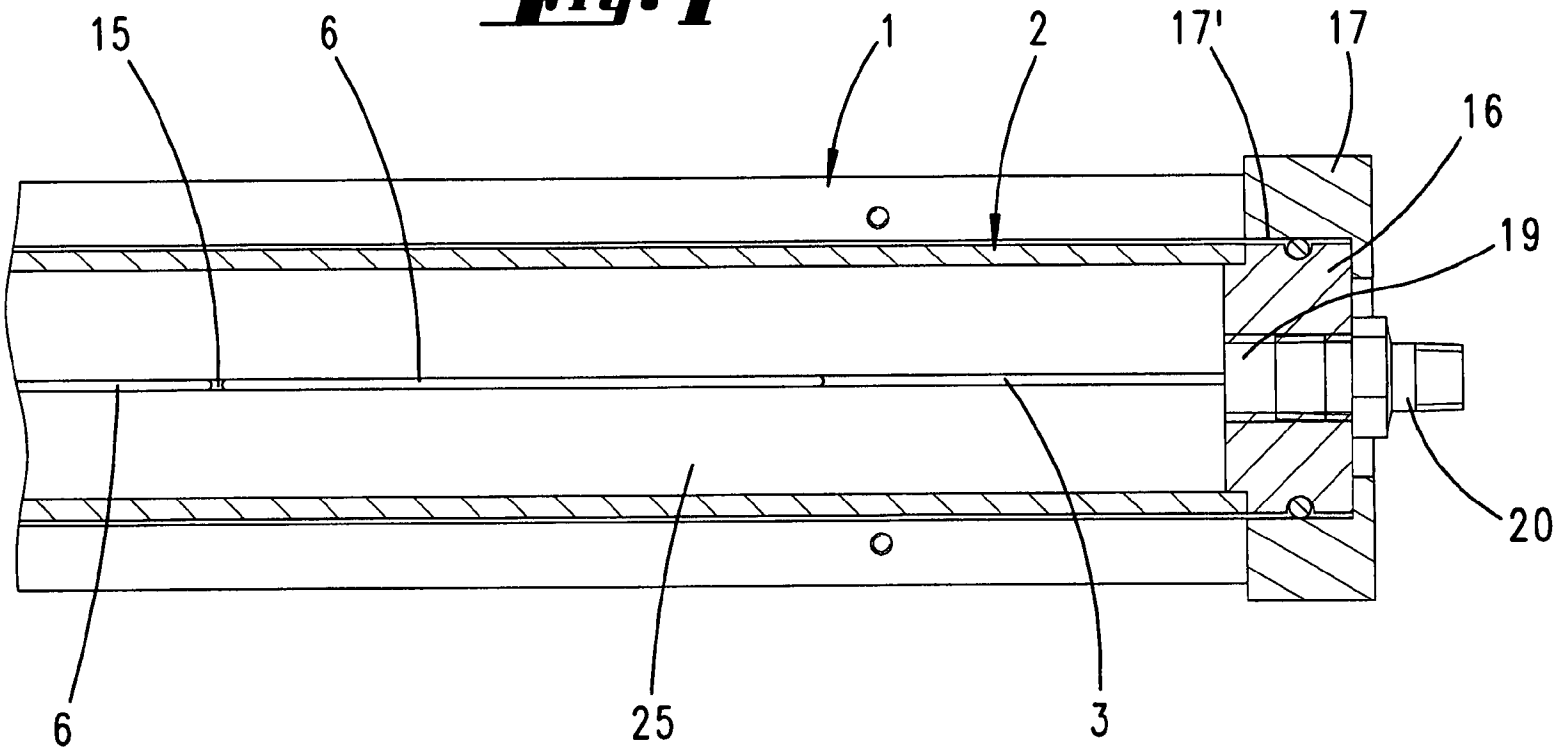
Figure 8:
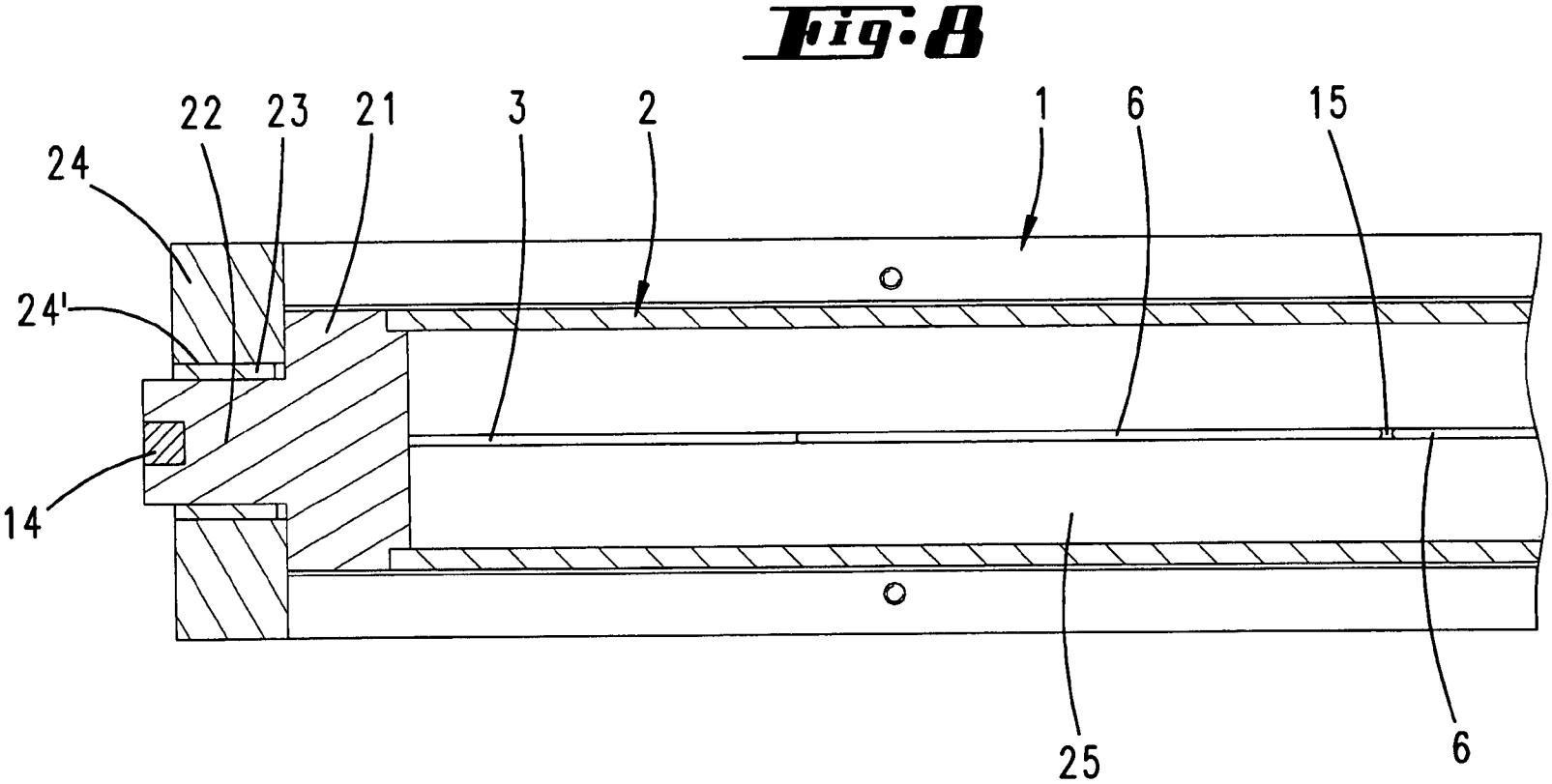
FIG. 8 shows a section on the line VIII-VIII in FIG. 3.
Figure 9:
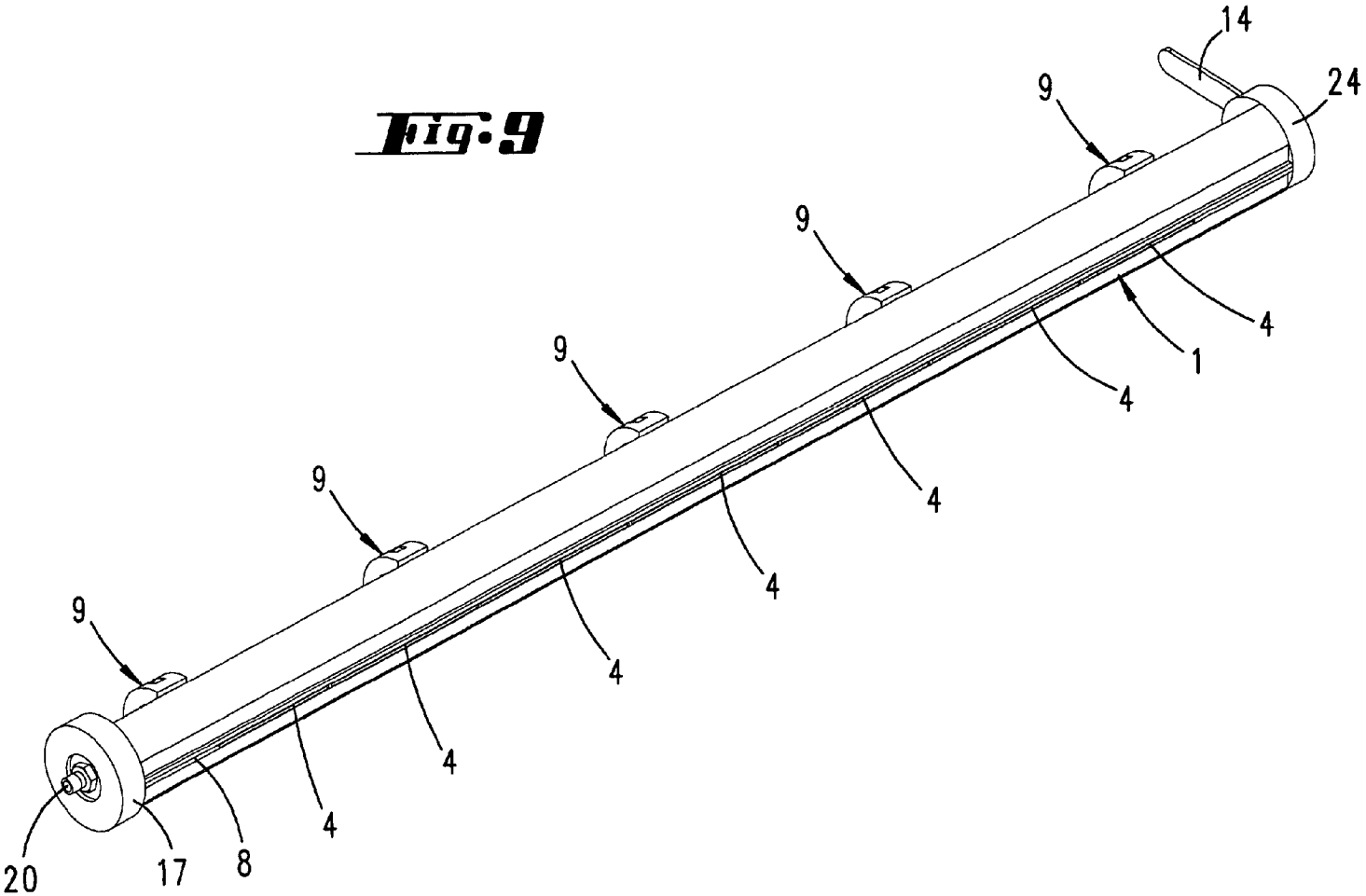
FIG. 9 shows a further perspective representation of the wide-slot nozzle.
Figures 10, 11:
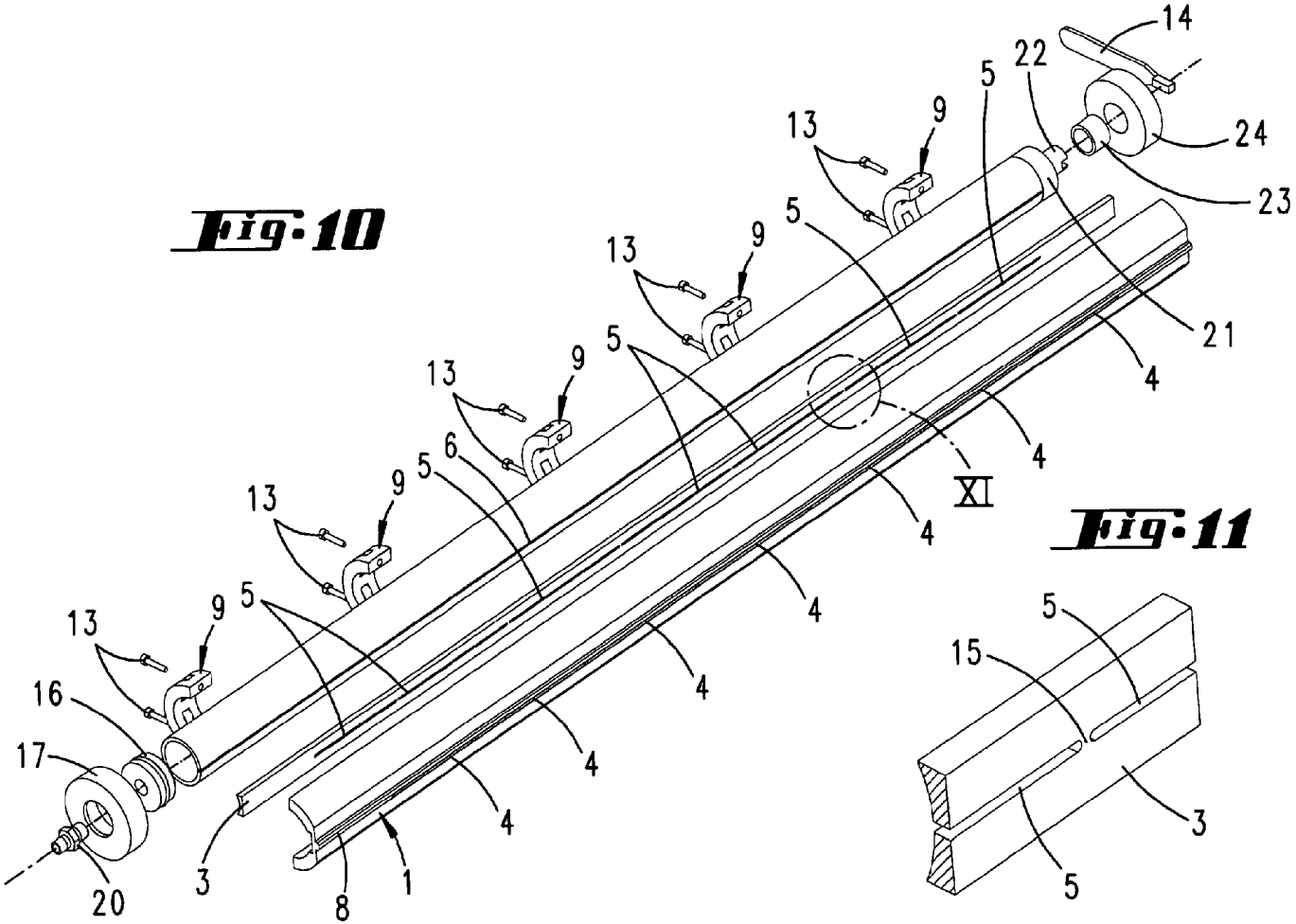
FIG. 10 shows an exploded illustration of the individual elements of the wide-slot nozzle.
FIG. 11 shows an extract according to line XI in FIG. 10.

The tube 2 forms a distributor for a medium and is mounted in the hollow space of the half tube. The tube 2 has an elongate slot 6 extending over the entire length of the tube 2. The elongate slot 6 is flanked by sealing surfaces 2', which lie in sealing abutment against the counter-sealing surfaces 3' of the sealing strip 3. In the circumferential direction of the tube 2, the sealing strip 3 extends only over the immediate apex region of the tube 2, by way of its counter-sealing surfaces 3' that run on an inner cylindrical surface. Only small radial forces are therefore necessary in order to achieve a sufficiently high compressive action on the surfaces in the region of the abutment faces (sealing surfaces 2', 3'). As shown in FIGS. 5 and 6, the elongate slit 5 of the sealing strip 3 is dimensioned such that slit 5 is shorter than the longitudinal slot forming the discharge nozzle 4. In addition, the elongate slit 5 is dimensioned such that the slit 5 is shorter than the longitudinal slot 6 of the tube 2 (i.e., medium distributor).

The tube is closed at its end faces by mounting plugs 16, 21. The mounting plugs 16, 21 may be glued to the tube 2. The mounting plug 21 forms a central projection 22 which is mounted in the mounting recess 24' of the headpiece 24, with a mounting ring being interposed. A portion of the mounting extension 22 projects outwards at the end. A switch lever 14 is secured to this.

The mounting plug 16 is mounted, with interposition of a bearing ring, in the mounting recess 17' of the headpiece 17. The mounting plug 16 forms a central opening 19 into which a coupling piece 20 is screwed. The coupling piece 20 may be connected to a supply hose or a supply pipe, so that the interior 25 of the tube 2 can be filled with a flowable medium through the feed opening 19. The interior of the tube 2 thus forms a reservoir 25.

A total of five arcuate pressure pieces 9 are provided, each pressure piece 9 providing two pressure rollers 10, in each case rotatable about a bearing axis 12. The two ends of the pressure piece 9 are connected to the two edges of the half tube by means of clamping bolts 13. The pressure pieces complement the cross-section of the half tube 1 to provide a complete tube, the pressure rollers 10 being able to be brought into a pressurizing engagement against the outer wall of the tube 2 by means of the pressure force that can be applied by the clamping bolts 13 and is adjustable. The arcuate piece forming a pressure piece 9 has an inner wall which faces towards the tube 2 and is spaced apart from the outer wall 27 of the tube 2. The pressure rollers 10 have portions which project into this spacing clearance. As can be gathered from the cross-sectional illustrations of FIGS. 5 and 6, the pressure rollers 10 are laterally displaced with respect to a diametral line running through the discharge nozzle 4, so that the bearing axes 12 and the discharge nozzle 4 form points of an isosceles triangle. A force in the radial direction can be exerted on the tube 2 by the pressure pieces 9 that are substantially uniformly spaced apart from one another, the force being conducted into the oppositely disposed sealing surfaces 2', 3'. Local adjustment of the force may be made by means of the clamping bolts 13, so that it is possible to compensate locally for manufacturing tolerances along the run of the sealing surfaces 2' 3'. If, in the longer run, leakages occur locally, these may be alleviated by tightening the clamping bolts 13 of the pressure piece 9 at this location.

The manner of functioning of the device is as follows:

The reservoir 25 is supplied with a flowable medium, in particular a medium of low to middle viscosity, through the supply opening 19 or through the coupling piece 20 that is screwed into the supply opening 19. As regards this medium, it is preferably a texture paint which is to be applied to a planar surface of a workpiece. For this purpose the wide-slot nozzle is fitted into a device not shown, so that the wide-slot nozzle may be displaced relative to the workpiece or the workpiece may be displaced relative to the wide-slot nozzle, at a uniform speed. In the position shown in FIG. 5, the medium may be discharged from the discharge nozzle 4. It enters therefore initially through the slot 6 into the slit 5 of the sealing strip 3 which is aligned with the slot and is interrupted only to a small extent and from there it enters into the longitudinal slot of the discharge nozzle 4, which is likewise also in alignment with the slit. The opening of the discharge nozzle 4 is flanked by lips 8 that extend in the radial direction and are formed by free edges that run parallel to one another.

The application of the medium is effected either from above and downwardly onto horizontal surfaces, or sidewise in the vertical direction onto vertical surfaces. It is, however, also possible to work with the wide-slot nozzle by way of a head, so that horizontal surfaces may be coated from below.

By means of the switch lever 14, the medium distributor 2 may be displaced from the open position shown in FIG. 5 into the closed position shown in FIG. 6. In this closed position, the slot 6 of the tube 2 opens against a sealing surface 3' of the sealing strip 3, so that the longitudinal slot of the tube 2 is closed. In this position, no medium can exit through the discharge nozzle 4. This is only once again possible when the medium distributor 2 has been rotated back into the open position shown in FIG. 5 by means of the switch lever 14.

All features disclosed are (in themselves) pertinent to the invention. The disclosure content of the associated/attached priority documents (copy of the prior application) is herby also included in full in the disclosure of the application, also for the purpose of incorporating features of these documents in claims of the present application. The sub-claims characterize in their optionally subordinated structure independent inventive developments of the state of the art, in particular for the purpose of undertaking divisional applications based on these claims.

The invention claimed is:

1. A device for applying a flowable medium onto a planar surface of a workpiece, the device having a housing that forms an elongate discharge nozzle for the medium and a medium distributor which is rotatably disposed in the housing and is formed as a cylindrical tube, the medium distributor having a slot extending in the axial direction of the tube, the position of the slot with respect to the discharge nozzle being altered by rotation of the medium distributor, and an outer wall of the medium distributor forming sealing surfaces which engage in a sealing manner against counter-sealing surfaces, the interior of the tube forming a reservoir which can be supplied with the medium by a supply opening, the slot running in such a manner that it can be brought from an open position, in which it forms a through opening from the reservoir to the discharge nozzle, the through opening being open substantially over its entire length, into a closed position in which the through opening is completely closed, characterized in that the counter-sealing surfaces are formed by a sealing strip which is inserted in a cut-out of the housing and has a slit that is aligned with the discharge nozzle; and the medium distributor is pressed with a locally adjustable force against the counter-sealing surfaces flanking the slit by means of pressure pieces that are associated with the housing and are spaced apart from one another in the axial direction of the tube.

2. The device according to claim 1, characterized in that the housing forms a half tube having an axial slot forming the discharge nozzle.

3. The device according to claim 1, characterized in that the sealing strip extends out of the cut-out in the manner of a pedestal, so that the interior wall of the housing runs at a spacing from the outer wall of the medium distributor.

4. The device according to claim 1, characterized in that the slit of the sealing strip is interrupted by webs that are spaced apart from one another.

5. The device according to claim 1, characterized in that the discharge nozzle is flanked by lips that extend substantially in a radial direction.

6. The device according to claim 1, characterized in that the two end openings of the tube forming the medium distributor are closed by mounting plugs, one mounting plug forming a mounting extension which is mounted in a headpiece of the housing, and the other mounting plug providing the supply opening and likewise being mounted in a headpiece of the housing.

7. The device according to claim 1, characterized in that an axial slot forming the discharge nozzle extends substantially over an entire axial length of the housing, which is provided with headpieces at its two ends.

8. The device according to claim 1, characterized in that the axial slot of the tube extends substantially over the entire axial length of the tube, which is provided at its ends with respective mounting plugs.

9. The device according to claim 1, characterized in that the slit of the sealing strip which is aligned with the discharge nozzle has interruptions formed by short webs that are substantially uniformly spaced apart, and the slit is as a whole shorter than the slot forming the discharge nozzle and the slot of the medium distributor.

10. The device according to claim 9, characterized in that a width of each web measured in a slit direction corresponds to approximately the slit width of the slit.

11. The device according to claim 6, characterized by a switch lever disposed on the mounting plug forming the mounting extension, the switch lever being adapted to rotate the medium distributor between the open position and the closed position.

12. A device for applying a flowable medium onto a planar surface of a workpiece, the device having a housing that forms an elongate discharge nozzle for the medium and a medium distributor which is rotatably disposed in the housing and is formed as a cylindrical tube, the medium distributor having a slot extending in an axial direction of the tube, the position of the slot with respect to the discharge nozzle being altered by rotation of the medium distributor, and an outer wall of the medium distributor forming sealing surfaces which engage in a sealing manner against counter-sealing surfaces, the interior of the tube forming a reservoir which can be supplied with the medium by a supply opening, the slot running in such a manner that it can be brought from an open position, in which it forms a through opening from the reservoir to the discharge nozzle, the through opening being open substantially over its entire length, into a closed position in which the through opening is completely closed, characterized in that the counter-sealing surfaces are formed by a sealing strip which is inserted in a cut-out of the housing and has a slit that is aligned with the discharge nozzle;

the medium distributor is pressed with a locally adjustable force against the counter-sealing surfaces flanking the slit by means of pressure pieces that are associated with the housing and are spaced apart from one another in the axial direction of the tube; and the pressure pieces are arcuate-shaped bodies that are spaced apart from one another, said pressure pieces each having pressure ends, said pressure ends being in each case pressed against edges of the housing.

13. A device for applying a flowable medium onto a planar surface of a workpiece, the device having a housing that forms an elongate discharge nozzle for the medium and a medium distributor which is rotatably disposed in the housing and is formed as a cylindrical tube, the medium distributor having a slot extending in an axial direction of the tube, the position of the slot with respect to the discharge nozzle being altered by rotation of the medium distributor, and an outer wall of the medium distributor forming sealing surfaces which engage in a sealing manner against counter-sealing surfaces, the interior of the tube forming a reservoir which can be supplied with the medium by a supply opening, the slot running in such a manner that it can be brought from an open position, in which it forms a through opening from the reservoir to the discharge nozzle, the through opening being open substantially over its entire length, into a closed position in which the through opening is completely closed, characterized in that the counter-sealing surfaces are formed by a sealing strip which is inserted in a cut-out of the housing and has a slit that is aligned with the discharge nozzle;

the medium distributor is pressed with a locally adjustable force against the counter-sealing surfaces flanking the slit by means of pressure pieces that are associated with the housing and are spaced apart from one another in the axial direction of the tube; and the pressure pieces provide pressure rollers, wherein said pressure rollers are positioned, in terms of cross-section of said device, relative to said discharge nozzle such that said pressure rollers and said discharge nozzle form an isosceles triangle shape, and said pressure rollers engage and support against the outer wall of the medium distributor.

* * * * *